United States Patent [19]

Nozaki et al.

[11] 4,215,662

[45] Aug. 5, 1980

[54] FUEL INJECTION APPARATUS FOR DIESEL ENGINES

[75] Inventors: Shinya Nozaki; Shouichi Suzuki, both of Higashimatsuyama, Japan

[73] Assignee: Diesel Kiki Co., Ltd., Tokyo, Japan

[21] Appl. No.: 863,442

[22] Filed: Dec. 22, 1977

[30] Foreign Application Priority Data

Dec. 25, 1976 [JP] Japan ..... 51-155647

[51] Int. Cl.[2] ..... F02D 1/02

[52] U.S. Cl. ..... 123/447; 123/449; 123/467

[58] Field of Search ..... 123/139 BC, 139 BE, 123/139 AS, 139 AT, 139 AL, 139 AM, 139 AP, 139 AQ

[56] References Cited

U.S. PATENT DOCUMENTS

| | | | |
|---|---|---|---|
| 2,027,360 | 1/1936 | Alden | 123/139 BC X |
| 2,667,152 | 1/1954 | Lang | 123/139 BC |
| 2,750,933 | 6/1956 | Lauck | 123/139 BC |
| 2,955,583 | 10/1960 | Dahl et al. | 123/139 BC |
| 3,033,182 | 5/1962 | Allen | 123/139 BC |
| 3,036,565 | 5/1962 | Reiners | 123/139 AT |
| 3,955,547 | 5/1976 | Aoki et al. | 123/139 BC |
| 4,164,923 | 8/1979 | Kimata et al. | 123/139 BC X |

FOREIGN PATENT DOCUMENTS

| | | | |
|---|---|---|---|
| 854677 | 11/1960 | United Kingdom | 123/139 AT |

*Primary Examiner*—Tony M. Argenbright

*Attorney, Agent, or Firm*—Birch, Stewart, Kolasch & Birch

[57] ABSTRACT

The present invention is directed to a fuel injection apparatus for injecting fuel into diesel engine cylinders, comprising multi-type plunger pumping units for pressurizing a fuel to be supplied from a fuel tank into the cylinders of a diesel engine, an accumulation for accumulating therein the fuel pressurized by the multi-type plunger pumping units, a fuel flow control valve for successively distributing the pressurized fuel toward the cylinders of the diesel engine, and fuel injection nozzles, each being disposed adjacent to one of the diesel engine cylinders for injecting the pressurized fuel distributed by the fuel control valve into the adjacent cylinder of the diesel engine.

6 Claims, 4 Drawing Figures

44
25
24
23
26
22
27
32
10
14
9
1
5
6
7
4a
2
3
8
4

FUEL INJECTION APPARATUS FOR DIESEL ENGINES

FIELD OF THE INVENTION

The present invention relates to a fuel injection apparatus adapted for use in diesel engines, and more particularly relates to a novel arrangement for injecting a fuel into a diesel engine for road vehicles with an optimum injection timing.

BACKGROUND OF THE INVENTION

One conventional fuel injection apparatus used for road vehicle diesel engines is known as a so-called Bosch type fuel injection pump apparatus in which a camshaft connectable to an engine is incorporated for the purpose of driving plungers. The plungers are arranged in plunger barrels, respectively, so as to reciprocally move upon being driven by the camshaft. The reciprocal motion of each plunger in the corresponding plunger barrel pressurizes a fuel introduced into the fuel injection pump apparatus. Thus, the pressurized fuel is delivered to fuel injection nozzles which in turn inject the fuel into each of cylinders of the diesel engine. Further each of the plungers is formed, in the outer surface, with a recess cooperable with a fuel inlet and outlet opening formed in the corresponding barrel. Therefore, by adjusting a positional relationship between the recess of each plunger and the fuel inlet and outlet opening of the corresponding barrel, the amount of fuel delivered from the fuel injection pump apparatus to each cylinder of the diesel engine can be adjusted. However, if the above-mentioned conventional Bosch type fuel injection pump apparatus is employed, the amount of fuel injected into each cylinder of the diesel engine cannot be accurately regulated both at the moments of starting and ending of each injection operation. That is, a transient change in the amount of fuel injected into each engine cylinder occurs at the moments of starting and ending of the injection operation of the fuel injection pump apparatus. This fact often results in causing unstable combustion in the diesel engine. Accordingly, exhaust emission from the engine contains unfavorable harmful components, such as hydrocarbon and carbon monoxide. Further, in the conventional Bosch type fuel injection pump apparatus, the cams on the camshaft are formed as tangential cams. As a result, a change in the torque of the camshaft occurs. Consequently, as the cams of the camshaft drive the contiguous plungers, an unfavorable noisy sound is generated.

The other conventional fuel injection apparatus adapted for use in diesel engines is described in the Japanese Published Patent No. 52(1977)-37132. In accordance with the description of the Japanese Published Patent, it is understood that some pressure-accumulating means is employed for overcoming the transient change in the amount of fuel injected into each diesel engine cylinder which change is encountered with the first-mentioned conventional Bosch type fuel injection pump apparatus. However, the this conventional fuel injection apparatus requires a complicated the internal structure for the pumping means used.

SUMMARY OF THE INVENTION

An object of the present invention is to provide a fuel injection apparatus for road vehicle diesel engines whereby the above-mentioned defects encountered with the conventional fuel injection apparatuses are obviated.

Another object of the present invention is to provide a novel simple arrangement for injecting a fuel into cylinders of road vehicle diesel engines with optimum injection timing.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
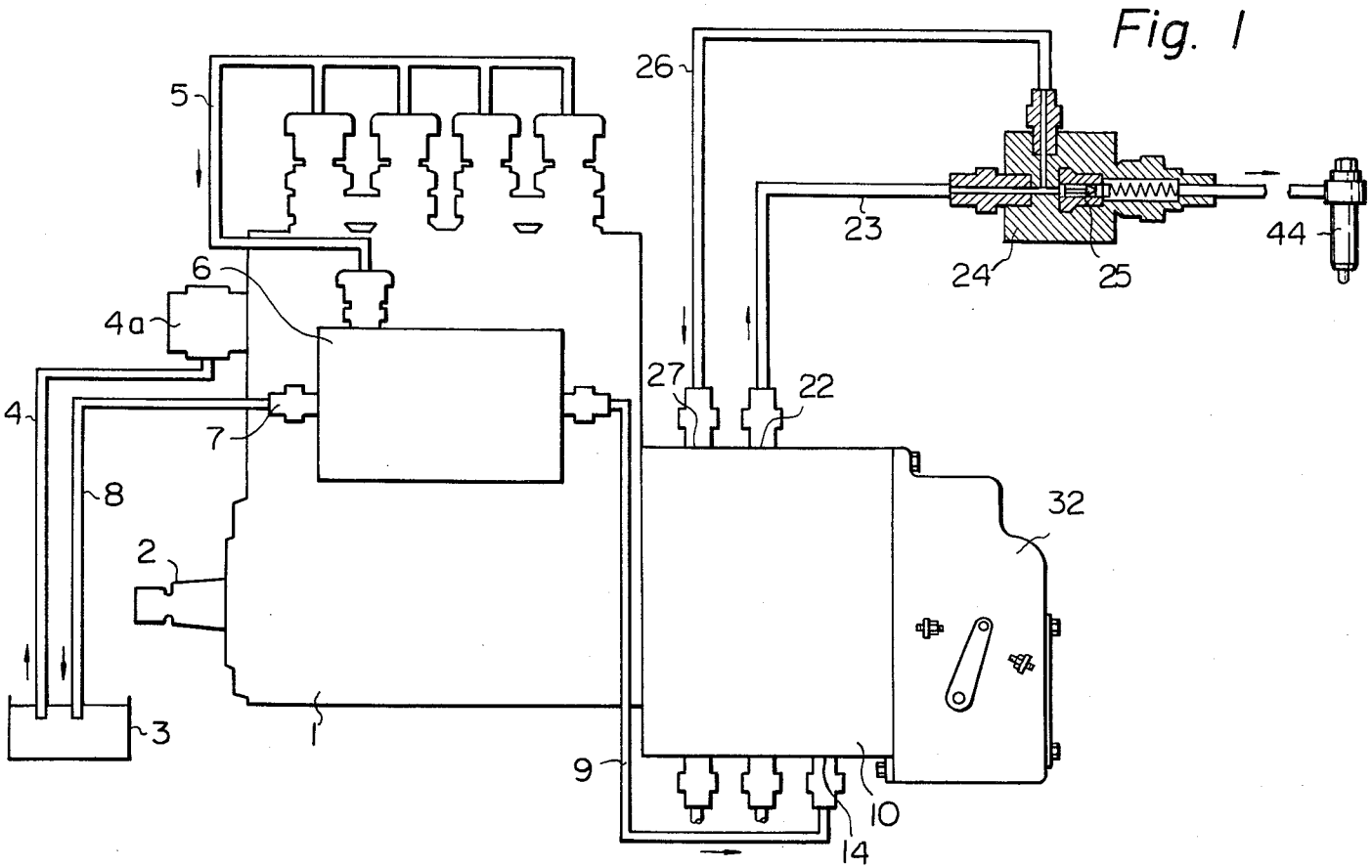
FIG. 1 is a schematic view, in partial cross-section, of a fuel injection apparatus according to a preferred embodiment of the present invention.

Referring now to FIG. 1 which schematically illustrates an entire arrangement of a fuel injection apparatus according to a preferred embodiment of the present invention, a fuel injection pump 1 includes a camshaft 2 connectable to a diesel engine for road vehicles. The camshaft 2 has mounted thereon cam discs (not shown) and rotatable therewith. Therefore, when the camshaft 2 is rotated by the diesel engine, the cam discs of the camshaft 2 operates so as to cause reciprocal motion of plungers (not shown) incorporated in the fuel injection pump. Reference numeral 3 designates a fuel tank for storing a fuel therein. The fuel in the fuel tank 3 is supplied, via a piping 4, into the fuel injection pump 1 by the pumping action of a feed pump 4*a*. The fuel supplied into the fuel injection pump 1 is pressurized in the pump 1 under reciprocating motion of the plungers and is then delivered toward an accumulator 6 by way of a piping 5. The accumulator 6 has an accumulating chamber therein for containing the pressurized fuel, and a check valve 7 which is normally closed and is opened when the pressure of the pressurized fuel in the accumulating chamber reaches a predetermined level. When the check valve 7 is opened, the pressurized fuel in the accumulator 6 is returned to the fuel tank 3 via piping 8. Therefore, the pressure of the pressurized fuel in the accumulating chamber of the accumulator 6 is maintained at an appropriate level below the predetermined level. The pressurized fuel in the accumulator 6 is delivered toward a fuel flow control valve 10 described later in detail, via piping 9. The fuel flow control valve 10 operates so as to distribute the pressurized fuel toward manifold elements 24 (only one manifold element 24 is shown in FIG. 1) via pipings 23. The manifold elements 24 deliver the pressurized fuel toward corresponding fuel injection nozzles 44 so that the fuel is injected into the diesel engine through the nozzles 44. In FIG. 1, reference numeral 25 designates a delivery valve of each manifold 24, and numeral 26 designates fuel return pipings running from each manifold element 24 toward the fuel flow control valve 10. Reference numeral 32 designates a mechanical governor attached to the fuel flow control valve 10, described hereinbelow with reference to FIGS. 2 and 3.

Figure 2:
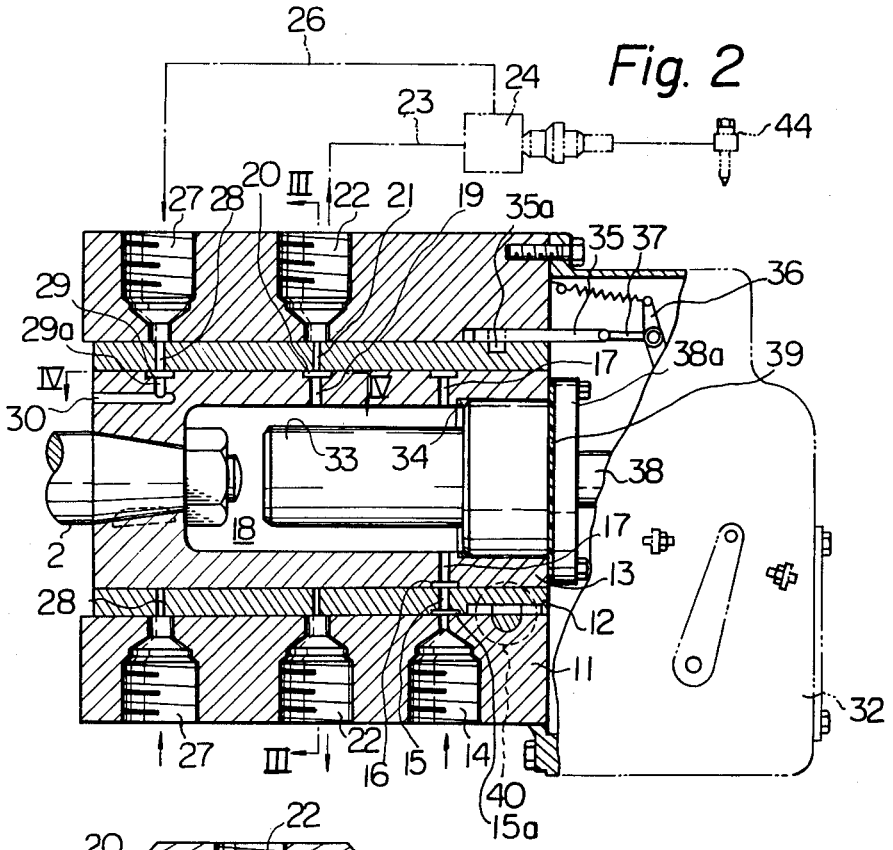
FIG. 2 is a cross-sectional view of a fuel flow control valve used in the apparatus of FIG. 1.
Figure 3:
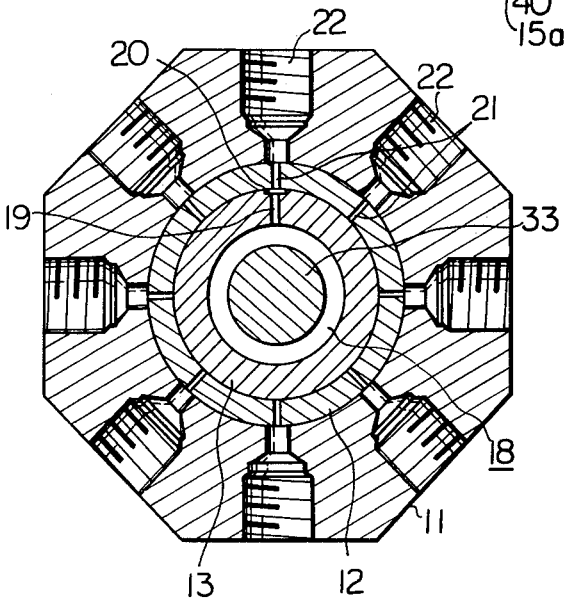
FIG. 3 is a cross-sectional view taken along the line III—III of FIG. 2.

FIGS. 2 and 3 illustrate the internal structure of the fuel flow control valve 10. The control valve 10 has an outer cylinder 11, a cylindrical bushing 12 received in the outer cylinder 11, a rotor 13 connected to the camshaft 2 by means of a suitable bolt-nut mechanism, and a plug 33. The rotor 13 is rotatably fitted in the cylindrical bushing 12 which in turn is axially and angularly movably fitted between the outer cylinder 12 and the rotor 13.

Figure 4:
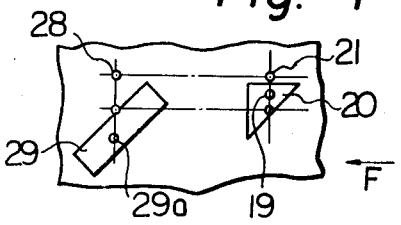
FIG. 4 is a view taken on the line IV—IV of FIG. 2, illustrating predetermined shapes of recesses formed in a rotating valve element of the fuel flow control valve of FIG. 2.

The outer cylinder 11 is formed with an inlet port 14 to which the afore-mentioned piping 9 from the accumulator 6 (FIG. 1) is connected. The inlet port 14 of the outer cylinder 11 is connected to a passageway 15 formed in the cylindrical bushing 12, via an elongated counterbore 15*a* which is also formed in the bushing 12. That is to say, due to the formation of the elongated counterbore 15*a*, the inlet port 14 is always fluidly connected to the passageway 15 even if the cylindrical bushing 12 is axially or angularly moved from the position shown in FIG. 2. The rotor 13 is formed with an annular groove 16 which is always connected to the passageway 15 of the bushing 12, and a fuel chamber 18 connected to the annular groove 16, via plural through-passageways 17. One end of the chamber 18 is tightly closed by the plug 33, via an appropriate sealing 34. The rotor 13 is also formed with a recess 20 having a predetermined triangular shape as shown in FIG. 4. The triangular recess 20 is always connected to the fuel chamber 18 by means of a through-passageway 19. The cylindrical bushing 12 is formed with through-passageways 21 which are intermittently connected to the triangular recess 20 of the rotor 13, respectively, while the rotor 13 is rotating with the camshaft 2. The through-passageways 21 are circumferencially arranged at an equiangular space, and the number of said through-passageways 21 corresponds to the number of the cylinders of a diesel engine to which the fuel injection apparatus of FIG. 1 is applied. Each of the through-passageways 21 is always connected to adjacent delivery port 22 formed in the outer cylinder 11. Therefore, the number of delivery port 22 also corresponds to the number of the diesel engine cylinders. In the embodiment of FIGS. 2 and 3, eight through-passageways 21 and eight delivery ports 22 are formed. Each of the ports 22 is connected to one of the manifold elements 24 (FIG. 1), via the piping 23. Also, when the delivery valve 25 is opened, each port 22 is fluidly connected to the corresponding fuel injection nozzle disposed in one of the diesel engine cylinders. Each port 22 is also fluidly connected to an associated return port 27 formed in the outer cylinder 11, via the manifold element 24 and the piping 26 (FIG. 1). Therefore, the number of the return ports 27 of the outer cylinder 11 is the same as that of the delivery port 22. Each return port 27 is always connected to an adjacent through-passageway 28 formed in the cylindrical bushing 12. Accordingly, the number of the through-passageways 28 of the cylindrical bushing 12 is equal to that of the return ports 27. Each of the through-passageways 28 is intermittently connected to a recess 29 formed in the rotor 13 while the rotor 13 is rotating with the camshaft 2. As shown in FIG. 4, the recess 29 is shaped as a rectangular recess which is inclined with respect to the axis of the cylindrical bushing 12. The rectangular recess 29 of the cylindrical bushing 12 is also connected to a radial hole 29*a* and an axial hole 30 both formed in the rotor 13. The radial hole 29*a* and axial hole 30 are provided as a return conduit for the fuel which is returned to the return ports 27 from the manifold elements 24 during the operation of the fuel injection apparatus of the present invention.

With the above-described internal structure of the fuel flow control valve 10, while the fuel injection apparatus of the present invention is being operated, the pressurized fuel is always supplied from the accumulator 6 (FIG. 1) into the fuel chamber 18, via the piping 9 (FIG. 1), the inlet port 14 of the outer cylinder 11, the counterbore 15*a* and the passageway 15 of the cylindrical bushing 12, and the annular groove 16 and the through-passageways 17 of the rotor 13. While the rotor 13 performs one complete rotation along with the camshaft 2, the triangular recess 20 is sequentially connected to the through-passageways 21 of the cylindrical bushing 12. Therefore, at the moment one of the through-passageways 21 is connected to the triangular recess 20, the pressurized fuel in the fuel chamber 18 of the rotor 13 flows through the connected through-passageways 21 of the bushing 12 toward the corresponding delivery port 22. Subsequently, the pressurized fuel in the delivery port 22 flows toward the associated manifold element 24 (FIG. 1), via the piping 23 (FIG. 1). When the pressurized fluid reaches the maniflod element 24, the delivery valve 25 (FIG. 1) of said manifold element 24 is opened by the action of the pressure of the pressurized fuel, and thus the pressurized fuel flows toward the associated fuel injection nozzle through which the fuel is injected into the diesel engine cylinder. From this stage, when the rotor 13 is further rotated by an small angular amount, the through-passageway 21 of the cylindrical bushing 12, which has been theretofore connected to the triangular recess 20, is disconnected from the recess 20 of the rotor 13. Concurrently, the rectangular recess 29 of the rotor 13 comes into connection with one of the through-passageways 28 of the bushing 12. As a result, at this stage, the injection of the pressurized fuel into any of the diesel engine cylinders is stopped, since none of the manifold elements 24 is supplied with the pressurized fuel which is sufficient to open any of the delivery valves 25. On the other hand, the return of the pressurized fuel from one of the manifold elements 24 which has just stopped delivery of the fuel toward the associated fuel injection nozzle, is immediately commenced through the piping 26, the return port 27 of the outer cylinder 11 which is connected to the rectangular recess 29, the through-passageway 28 of the bushing 12, the rectangular recess 29, the radial hole 29*a*, and the axial hole 30, toward the fuel tank 3 (FIG. 1). Thereafter, when the rotor 13 is further rotated until the triangular recess 20 is again brought into a fluid connection with a subsequent one of the through-passageway 21 of the cylindrical bushing 12, another injection of the pressurized fuel into one of the diesel engine cylinders is carried out. Thus, while the rotor 13 performs one complete rotation, the injection of the pressurized fuel is successively performed for eight times by the fuel injection apparatus according to the embodiment of FIGS. 1 through 4.

The injection amount of the pressurized fuel and the injection timing are adjusted as follows. That is to say, the injection amount of the pressurized fuel is adjusted by moving the bushing 12 in the axial direction of the fuel flow control valve. As is obvious from the illustration of FIG. 4, when the bushing 12 is axially moved, a time period for which each through-passageway 21 of the bushing 12 meets with the triangular recess 20 of the rotor 13 during rotating of the rotor 13 changes. This change in the time period of meeting of each through-passageway 21 with the triangular recess 20 contributes to the adjustment of the injection amount of the pressurized fuel, since the injection amount of the pressurized fuel is changed depending upon the length of the above-mentioned time period. For example, when the amount of injection of the pressurized fuel should be increased, the bushing 12 is moved in the axial direction shown by an arrow "F" in FIG. 4. At this stage, it should be understood that even if the bushing 12 is axially moved, a time period for which each through-passageway 28 of the bushing 12 meets with the rectangular recess 29 during the rotation of the rotor 13 does not change. On the other hand, adjustment of the injection timing is performed by circumferentially moving the bushing 12 with respect to the rotor 13. That is to say, if the bushing 12 is circumferentially moved in a clockwise direction or counterclockwise direction about the axis of the control valve 10 from an initially set position of the bushing 12, the position that each through-passageway 21 of the bushing 12 begins to meet with the triangular recess 20 of the rotor 13 while the rotor 13 is being rotated, is changed. Due to this position change, any desired adjustment of the injection timing can be achieved. It should here be noted that the axial movement of the bushing 12 is caused, for example, by a lever 35 which has a pawl 35*a* engaged with the bushing 12. The lever 35 is connected to a floating lever 36 of the mechanical governor 32 via a link arm 37. The mechanical governor 32 is operatively connected to the rotor 13 of the fuel flow control valve 13 through a governor shaft 38 having a connecting flange 38*a* which acts also as a connecting flange of the plug 33. The connecting flange 38*a* is rigidly fixed to an end face of the rotor 13, via a sealing member 39, by means of an appropriate means, such as screw bolts as shown in FIG. 2. As a result, it will be understood that the mechanical governor 32 can operatively be associated with the diesel engine to which the fuel injection apparatus of the present invention is applied, via the rotor 13 and the camshaft 2 of the fuel flow control valve 10. Consequently, the mechanical governor 32 controls the axial movement of the bushing 12 via the floating lever 36, the link arm 37, and the lever 35, in response to a change in the operating condition of the diesel engine.

On the other hand, the circumferential movement of the bushing 12 of the fuel flow control valve 10 is controlled by an appropriate electric or hydraulic motor 40 having, on its output, a worm screw engaged with a partial gear teeth formed on the outer surface of the bushing 12. The motor 40 is arranged so as to be driven by a control signal related to the operating condition of the diesel engine.

From the foregoing description of the preferred embodiment, it will be understood that according to the present invention, the fuel to be injected is pressurized by the injection pump and is accumulated in the accumulator so that the pressure of the fuel is always maintained at a constant level. Therefore, when the pressurized fuel is distributed by the fuel flow control valve toward each injection nozzle of a diesel engine, no transient change in the flow amount of the pressurized fuel occurs. Therefore, an unfavorable transient change in the injection amount of the fuel does not occur in each cylinder of the diesel engine, at the moment of starting and ending of the injection operation. Accordingly, in the diesel engine to which the fuel injection apparatus of the present invention is applied, a stable combustion of the fuel always takes place. As a result, unfavorable hydrocarbon and carbonmonoxide contained in the exhaust emission from the diesel engine is considerably decreased.

Further, in the apparatus of the present invention, the injection pump 1 is employed for only the purpose of pressurizing the fuel to be injected to a desired pressure level. Therefore, the cam discs used in the injection pump can be formed of eccentric cam discs having small torque fluctuation. Therefore, during the pressurizing operation of the injection pump 1, no appreciable noise is generated. Further the employment of a single common fuel control for plural cylinders of the diesel engine can contribute to reducing the entire size and shape of the injection fuel apparatus used for diesel engines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection apparatus for use in a diesel engine comprising:

a multi-type plunger pumping means for pressurizing a fuel to be supplied from a fuel tank into cylinders of the diesel engine;

accumulator means for accumulating a quantity of pressurized fuel supplied from said multi-type plunger pumping means;

control valve means for successively distributing said pressurized fuel from said accumulator means to said cylinders of said diesel engine;

said control valve means including a fixed outer housing with a plurality of inlet ports and outlet ports positioned around the outer circumference thereof and a cylindrical bushing means rotatably and axially movable within said outer housing in response to operating conditions of the diesel engine, said bushing means including a plurality of inlet and outlet passageways which are adjustably aligned with said ports to permit said pressurized fuel to be supplied therethrough;

said control valve further including a rotatable rotor means with a plurality of through-passageways which are intermittently connected to said passageways in said bushing means to permit said pressurized fuel to be intermittently supplied therethrough, said rotatable rotor means being operatively connected to said diesel engine to rotate therewith, and including a fuel chamber for receiving said pressurized fuel from said accumulator means through a fuel inlet port in said outer housing and through-passageways in said cylindrical bushing means and said rotatable rotor means, said fuel chamber being in constant communication with said accumulator means and being successively connected to each of said fuel outlet ports during the rotation of said rotatable rotor means, said rotatable rotor means including a fuel outlet through-passageway in communication with said fuel chamber and a triangular shaped recess on an outer surface of said rotatable rotor means;

said bushing means being rotatably and axially adjustable relative to said rotatable rotor means to control injection timing and fuel quantity supplied through said control valve to said diesel engine cylinders by adjusting the exposure of said triangular shaped recess relative to one of said outlet passageway in said cylindrical bushing means; and fuel injection nozzles, each being disposed adjacent to one of said diesel engine cylinders and being in fluid communication with said control valve means for injecting said pressurized fuel distributed by said control valve means into said cylinder of said diesel engine.

2. A fuel injection apparatus as set forth in claim 1, wherein said pumping means includes a feed pump for introducing said fuel from said fuel tank into said pumping means.

3. A fuel injection apparatus as set forth in claim 1, wherein said accumulating means comprises an accumulating chamber for receiving therein said pressurized fuel to be accumulated and a check valve element provided for said accumulating chamber for permitting said pressurized fluid to return to said fuel tank when the pressure of said pressurized fuel in said accumulating chamber reaches a predetermined level.

4. A fuel injection apparatus as set forth in claim 1, further comprising manifold elements, each being disposed between said control valve means and one of said fuel injection nozzles, said each manifold element having therein a delivery valve for delivering a predetermined amount of said pressurized fuel toward corresponding one of said fuel injection nozzles.

5. A fuel injection apparatus as set forth in claim 4, wherein said manifold elements have a port connected to a return line through which an excess amount of said pressurized fuel other than said predetermined amount of said pressurized fuel is returned to said fuel tank via said control valve means.

6. A fuel injection apparatus according to claim 5, wherein said return line of said manifold elements is connected to a return port positioned on the outer circumference of said fixed outer housing, said return port being in communication with a rectangular recess on an outer surface of said rotatable rotor means to control the quantity of fuel returned to said fuel tank.

* * * * *